US010514649B2

(12) United States Patent
Yamaoka

(10) Patent No.: US 10,514,649 B2
(45) Date of Patent: Dec. 24, 2019

(54) IMAGE FORMING APPARATUS

(71) Applicant: CANON KABUSHIKI KAISHA, Tokyo (JP)

(72) Inventor: Takahiko Yamaoka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/458,171

(22) Filed: Mar. 14, 2017

(65) Prior Publication Data

US 2017/0277098 A1 Sep. 28, 2017

(30) Foreign Application Priority Data

Mar. 25, 2016 (JP) ..... 2016-062452
Mar. 25, 2016 (JP) ..... 2016-062453

(51) Int. Cl.

| | |
|---|---|
| ***B41J 13/00*** | (2006.01) |
| ***G03G 15/00*** | (2006.01) |
| *B41J 11/48* | (2006.01) |
| *B41J 11/00* | (2006.01) |

(52) U.S. Cl.

CPC ..... *G03G 15/6594* (2013.01); *G03G 15/6511* (2013.01); *B41J 11/009* (2013.01); *B41J 11/485* (2013.01); *B41J 13/0009* (2013.01); *B41J 13/0054* (2013.01); *G03G 15/502* (2013.01); *G03G 15/5029* (2013.01); *G03G 15/55* (2013.01); *G03G 2215/00481* (2013.01); *G03G 2215/00616* (2013.01); *G03G 2215/00738* (2013.01)

(58) Field of Classification Search

None

See application file for complete search history.

(56) References Cited

U.S. PATENT DOCUMENTS

| | | | | |
|---|---|---|---|---|
| 6,389,241 | B1 * | 5/2002 | Cernusak | G03G 15/2003 399/44 |
| 2002/0024575 | A1 * | 2/2002 | Sato | B41J 11/42 347/104 |
| 2005/0052520 | A1 * | 3/2005 | Yamazaki | B41J 11/009 347/106 |
| 2005/0078973 | A1 * | 4/2005 | Suzuki | B65H 7/14 399/45 |
| 2005/0213154 | A1 * | 9/2005 | Narusawa | B41J 11/009 358/1.18 |
| 2011/0058882 | A1 * | 3/2011 | Umeda | B41J 11/009 400/582 |
| 2012/0002227 | A1 * | 1/2012 | Ogino | B41J 11/009 358/1.12 |

(Continued)

FOREIGN PATENT DOCUMENTS

JP 2010-211062 A 9/2010

*Primary Examiner* — Jill E Culler

(74) *Attorney, Agent, or Firm* — Venable LLP

(57) ABSTRACT

An image forming apparatus includes a memory and a controller. The memory is configured to store information related to a recording medium type detected by a detector in the past. The controller is configured to control a feeder so as to prevent feeding of a recording medium from starting, when a printing operation is started in a first mode, in a case that a recording medium type set through a setting unit and a recording medium type discriminated based on the information stored in the memory do not match with each other.

19 Claims, 11 Drawing Sheets

(56) References Cited

U.S. PATENT DOCUMENTS

| | | | | |
|---|---|---|---|---|
| 2014/0029967 | A1* | 1/2014 | Kameda | G03G 15/2085 399/67 |
| 2014/0241742 | A1* | 8/2014 | Hoshi | G01N 21/4738 399/45 |
| 2015/0116743 | A1* | 4/2015 | Yamashita | H04N 1/2323 358/1.12 |
| 2017/0102631 | A1* | 4/2017 | Hirota | G03G 15/5062 |

* cited by examiner

FIG. 8A

PLEASE CHECK SETTING OF THE SHEET TYPE OR CHECK SHEET IN THE CASSETTE

THERE IS A POSSIBILITY THAT THE SETTING OF THE SHEET TYPE AND THE SHEET TYPE OF THE SHEET IN THE CASSETTE DO NOT MATCH WITH EACH OTHER.

SORRY FOR INCONVENIENCE, BUT PLEASE CHECK THE SETTING OF THE SHEET TYPE OR THE SHEET IN THE CASSETTE.

OK

FIG. 8B

PRINTING IS STOPPED

THE SHEET TYPE OF THE SHEET FED FROM THE CASSETTE IS CHANGED.

SORRY FOR INCONVENIENCE, BUT PLEASE CHECK THE SETTING OF THE SHEET TYPE OR THE SHEET IN THE CASSETTE.

OK

IMAGE FORMING APPARATUS

BACKGROUND OF THE INVENTION

Field of the Invention

The present invention relates to an image forming apparatus, which employs an electrophotographic system, an electrostatic recording system, or other systems.

Description of the Related Art

In an image forming apparatus which is configured to form an electrostatic latent image on a photosensitive member by laser beam light, develop the electrostatic latent image with toner to form a toner image, transfer the formed toner image onto a sheet, and thermally fix the toner image on the sheet, property information including a thickness and a surface property of a medium such as a sheet is an important control parameter. Through use of the property information of a medium, an optimum fixing temperature and conveyance speed for a sheet can be achieved. It has been generally known that the property information of a sheet is set through an operation by a user with an operation unit or a driver screen arranged in the image forming apparatus. In recent years, there has been proposed a configuration in which a sensor configured to detect a property of a medium is arranged in the image forming apparatus. Such a configuration eliminates the necessity of an operation by a user, thereby improving convenience.

In Japanese Patent Application Laid-Open No. 2010-211062, there is disclosed a sensor configured to detect a property of a medium (hereinafter referred to as medium sensor). Further, in Japanese Patent Application Laid-Open No. 2010-211062, there is disclosed a control which is performed when a different medium is detected during an image forming operation with a control parameter suitable for a certain medium. For example, the medium sensor configured to detect a property of a sheet is arranged on a conveyance path to perform detection of media with respect to a plurality of sheets which are successively fed. Then, when a property of a sheet which has already been output and a property of a sheet which is newly detected are different from each other, a print job is stopped.

SUMMARY OF THE INVENTION

In order to perform the detection of media through use of the media sensor arranged on the conveyance path, it is necessary to feed a sheet and convey the sheet to a position on the conveyance path at which the medium sensor is arranged. Then, when it is determined that a detection result given by the medium sensor and a control parameter for a current operation do not match with each other, it is necessary to stop a sheet conveyance operation and an image forming operation at the timing of the determination. Thus, in order to restart a subsequent print job, a user needs to check a sheet type of a sheet in a sheet-feeding cassette, change setting of a sheet type, and remove a sheet which stops on the conveyance path.

The present invention, which has been made under such a circumstance, has an object to improve usability even when a sheet type which has been set and a sheet type stored in a memory unit do not match with each other.

In order to achieve the above-mentioned object, the present invention has the following configuration.

According to one embodiment of the present invention, there is provided an image forming apparatus, including: a sheet accommodating unit in which a sheet is to be accommodated; a feeder configured to feed a recording medium stacked on the sheet accommodating unit; a detector configured to detect a recording medium type of a recording medium fed by the feeder; a setting unit configured to allow manual setting of a recording medium type; a memory configured to store information related to a recording medium type detected by the detector in the past; and a controller configured to control a printing operation in any one of a first mode of controlling the printing operation based on a set recording medium type and a second mode of controlling the printing operation based on a detection result given by the detector, and the controller configured to control the feeder so as to prevent feeding of a recording medium from starting, when the printing operation is started in the first mode, in a case that the set recording medium type and a recording medium type discriminated based on the information stored in the memory do not match with each other.

According to the present invention, usability can be improved even in the case where the sheet type which has been set and the sheet type stored in the memory unit do not match with each other.

Further features of the present invention will become apparent from the following description of exemplary embodiments with reference to the attached drawings.

BRIEF DESCRIPTION OF THE DRAWINGS

FIG. 8A illustrates an operation unit in the first embodiment.

FIG. 8B illustrates the operation unit in the first embodiment.

DESCRIPTION OF THE EMBODIMENTS

Preferred embodiments of the present invention will now be described in detail in accordance with the accompanying drawings.

First Embodiment

<Image Forming Apparatus>

Figure 1:
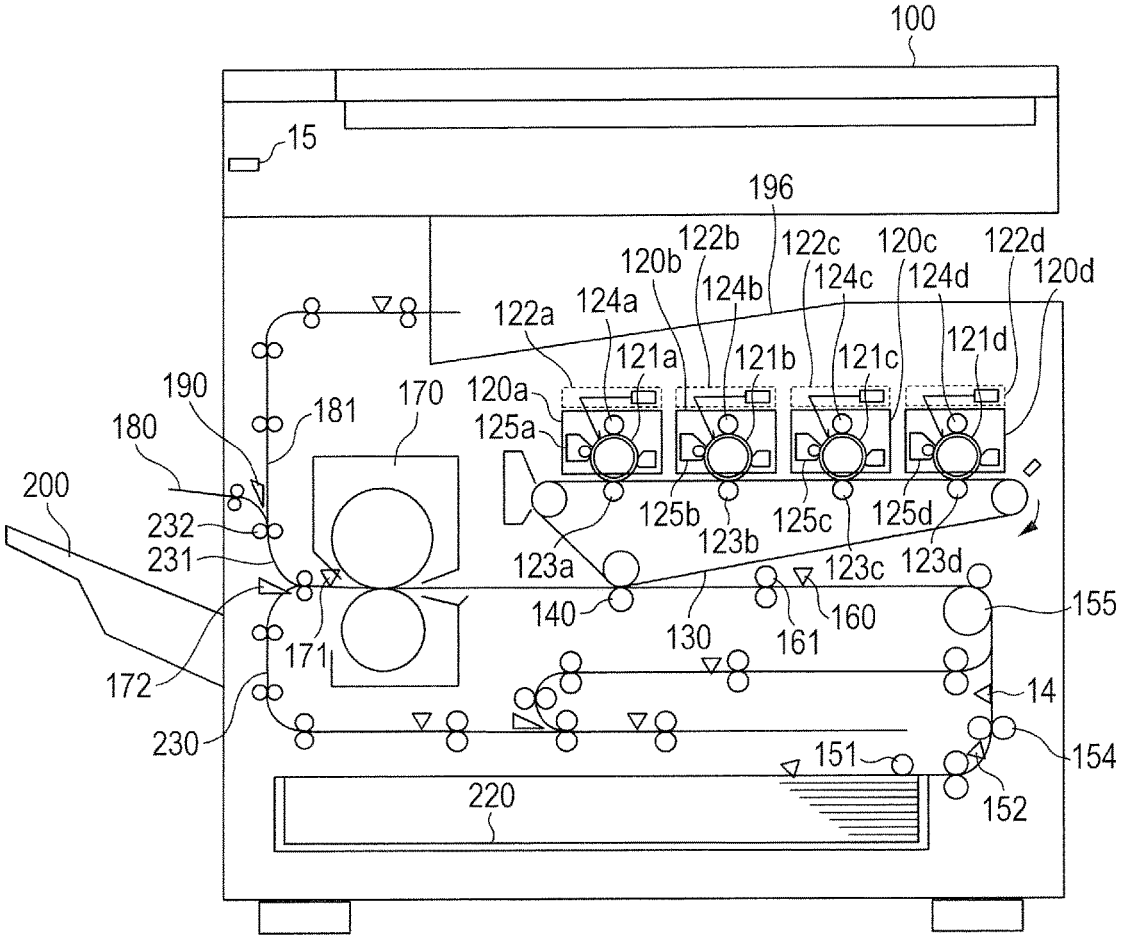
FIG. 1 is a sectional view of an image forming apparatus according to a first embodiment of the present invention.
Figure 2:
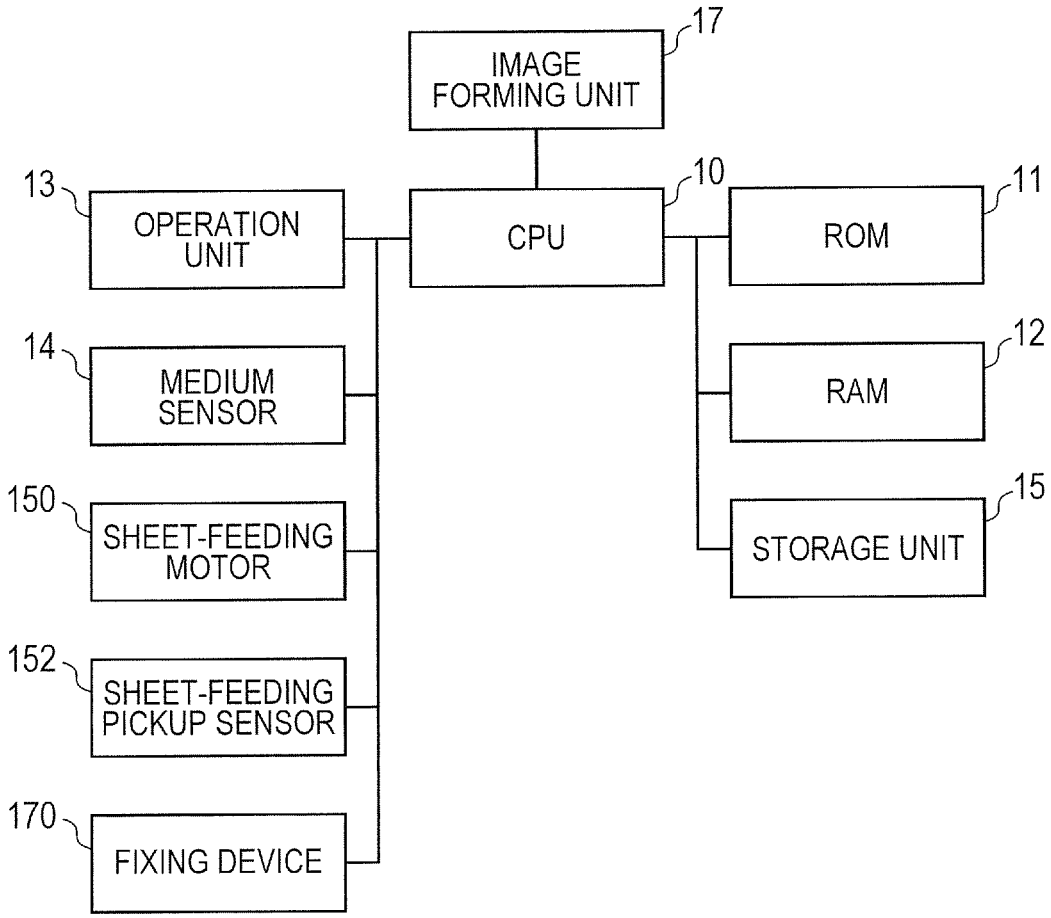
FIG. 2 is a block diagram of the image forming apparatus according to the first embodiment.

FIG. 1 is a sectional view of an image forming apparatus 100 according to a first embodiment of the present invention. FIG. 2 is a block diagram for illustrating a configuration of this embodiment. With reference to FIG. 1 and FIG. 2, a basic configuration is described. In FIG. 2, a CPU 10 being a controller, a ROM 11, a RAM 12, and a storage unit 15 being a memory are included in a control unit. An instruction of starting a printing operation (hereinafter referred to as operation start instruction) is input to the CPU 10 from an operation unit 13 being a setting unit. The CPU 10 controls driving of a sheet-feeding motor 150 (feeder) in accordance with the operation start instruction input from the operation unit 13 to feed and convey a sheet. Further, the CPU 10 monitors a sheet-feeding pickup sensor 152 to detect a position of the sheet in the image forming apparatus 100.

The CPU 10 controls an image forming unit 17. The image forming unit 17 controls application of a high voltage and driving for cartridges 120*a*, 120*b*, 120*c*, and 120*d* of FIG. 1. Herein, the suffixes a, b, c, and d of the reference symbols represent colors. For example, the suffixes a, b, c, and d represent yellow (Y), magenta (M), cyan (C), and black (K), respectively. In the following description, the suffixes a, b, c, and d are omitted except for a case where a specific color is described. The image forming unit 17 controls application of a high voltage or driving for an intermediate transfer belt 130, a primary transfer portion 123, and a secondary transfer portion 140, and controls a laser scanner 122. The ROM 11 stores procedures of image formation and procedures of a flowchart described later. A medium sensor 14 being a detector is configured to detect a quality of material (for example, thickness) of a sheet being conveyed on the conveyance path and output information related to a sheet type to the CPU 10. Details of the medium sensor 14 are described later.

With reference to FIG. 1 and FIG. 2, a basic image forming operation is described. When the CPU 10 receives the operation start instruction from the operation unit 13, the CPU 10 starts a sheet-feeding operation of feeding a sheet from a sheet-feeding cassette 220 being a sheet accommodating unit configured to stack a sheet being a recording medium. The CPU 10 drives the sheet-feeding motor 150, which serves as a drive source for a sheet-feeding pickup roller 151. Then, the sheet-feeding pickup roller 151 is driven to rotate so that the sheets in the sheet-feeding cassette 220 are fed and conveyed one after another. At this time, the CPU 10 monitors, through use of the sheet-feeding pickup sensor 152, whether or not the sheet-feeding operation is performed in a normal manner.

When a sheet, which has been picked up by the sheet-feeding pickup roller 151 and conveyed by conveyance rollers 154, is conveyed to a position of the medium sensor 14, the medium sensor 14 detects a quality of material (thickness) of the sheet. At this time, depending on a configuration of the medium sensor 14, the sheet is temporarily stopped at the position of the medium sensor 14, or the conveyance speed is reduced, in order to improve the reading accuracy. In this embodiment, there is no need to temporarily stop the conveyance of the sheet or reduce the conveyance speed at the time of performing detection by the medium sensor 14. The CPU 10 reflects information of the sheet detected by the medium sensor 14 to an image forming condition for image forming processing, for example, to a fixing temperature given at the time of performing fixing processing by a fixing device 170. As another image forming condition, for example, the conveyance speed of the sheet is changed to a conveyance speed associated with the information detected by the medium sensor 14, and the conveyance of the sheet is continued. For example, when it is determined that a sheet being conveyed is a thick sheet based on a detection result given by the medium sensor 14, the conveyance speed of the sheet is changed so that the conveyance speed becomes one-half (also referred to as one-half speed) of the conveyance speed of a normal sheet or a thin sheet. In this embodiment, as one example, the conveyance speed of the sheet is set to be constant and is unchanged, and the detection result given by the medium sensor 14 is reflected to the fixing temperature of the fixing device 170.

The CPU 10 controls the cartridge 120 to start the image forming operation so as to meet a timing at which the sheet arrives at the secondary transfer portion 140. The cartridge 120 is removably mounted to a main body of the image forming apparatus 100. After a surface of a photosensitive drum 121 is electrically charged by a charging roller 124, a latent image is formed on the photosensitive drum 121 by laser light irradiated from the laser scanner 122. The latent image formed on the photosensitive drum 121 is developed with toner in a developing device 125 so that a toner image is formed on the photosensitive drum 121. The toner image formed on the photosensitive drum 121 is transferred onto the intermediate transfer belt 130 by the primary transfer portion 123 having a transfer voltage applied thereto. The toner image having been transferred onto the intermediate transfer belt 130 moves to the secondary transfer portion 140 as the intermediate transfer belt 130 moves.

The CPU 10 monitors a registration sensor 160 to detect a position of the sheet conveyed by conveyance rollers 155. The CPU 10 controls the conveyance of the sheet so that, in consideration of a timing at which a leading edge of the sheet arrives at the registration sensor 160, the leading edge of the sheet and a leading edge of the toner image on the intermediate transfer belt 130 may match with each other at the secondary transfer portion 140. For example, when it is determined based on a detection result given by the registration sensor 160 that the sheet has arrived earlier than a prescribed timing, the CPU 10 stops the sheet at a position of registration rollers 161 for a predetermined time period and thereafter restarts the conveyance.

Through application of the transfer voltage to the secondary transfer portion 140, the toner image is transferred onto the sheet which has arrived at the secondary transfer portion 140. The sheet having the toner image transferred thereon is conveyed to the fixing device 170. The CPU 10 controls the temperature of the fixing device 170 to a temperature which is optimum for the sheet in accordance with the detection result given by the medium sensor 14. Details of the fixing device 170 are described later. After the toner image on the sheet is fixed to the sheet by the fixing device 170, the CPU 10 performs a control of conveying the sheet to downstream of the fixing device 170 in a conveyance direction of the sheet. When the leading edge of the sheet after fixation arrives at a conveyance sensor 171, the CPU 10 determines one of the conveyance path 230 and the conveyance path 231 as the conveyance path of the sheet in accordance with an instruction given in advance by the operation unit 13. The CPU 10 switches a flapper 172 in accordance with the determination to switch the conveyance paths of the sheet. Specifically, the CPU 10 performs switching so that the sheet is conveyed to the conveyance path 230 when printing is performed on a front surface (first surface) of the sheet during a duplex printing, and that the sheet is conveyed to the conveyance path 231 in a case of a simplex printing or in a case of printing on a back surface (second surface) during the duplex printing.

Now, the case where the sheet is conveyed to the conveyance path 231 is described. The sheet having been conveyed to the conveyance path 231 is further conveyed by conveyance rollers 232 to downstream in the conveyance direction. Also at this time, similarly to the switching described above, the CPU 10 switches a flapper 190 in accordance with an instruction given in advance by the operation unit 13. With this, the conveyance of the sheet can be switched between conveyance to a conveyance path 180 side and conveyance to a conveyance path 181 side. When a sheet delivery tray 200 is designated by a user as a destination of delivery of the sheet, the sheet is conveyed to the conveyance path 180 side. When a sheet delivery tray 196 is designated by a user as a destination of delivery of the sheet, the sheet is conveyed to the conveyance path 181 side. The above-mentioned basic image forming operation is one example, and the present invention is not limited to the above-mentioned configuration.

<Description of Fixing Device 170>

Figure 3:
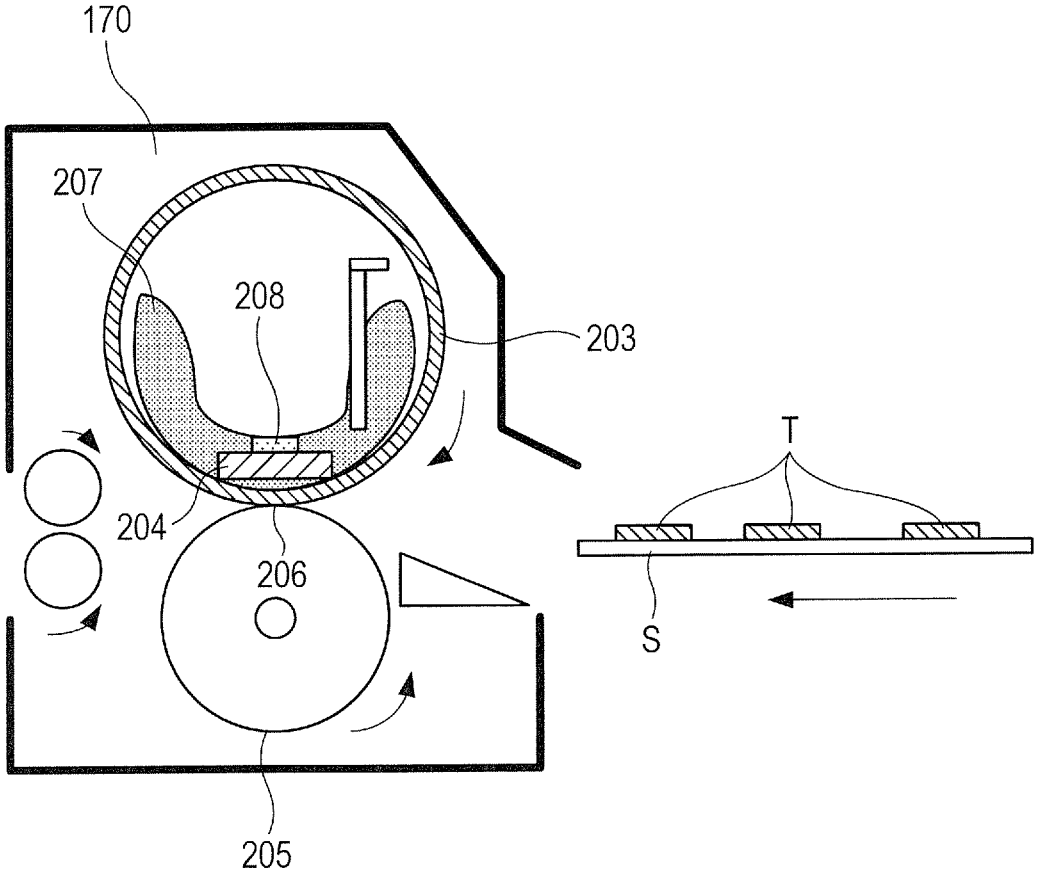
FIG. 3 is a sectional view of a fixing device in the first embodiment.

FIG. 3 is an illustration of a configuration of the fixing device 170. In FIG. 3, illustration is made of a state in which a sheet S bearing toner T is conveyed to the fixing device 170 in a direction of the arrow of FIG. 3. The fixing device 170 includes a heater holder 207, a fixing heater 204, and a fixing film 203. The fixing heater 204 is arranged in a fixed manner on a lower surface of the heater holder 207 so as to extend in a longitudinal direction of the heater holder 207, that is, in a direction orthogonal to the drawing, which is also a direction orthogonal to the conveyance direction of the sheet. The fixing film 203 includes an elastic layer. The pressure roller 205 is arranged so that both end portions of a metal core are pivotably born between side plates of the fixing device 170. The heater holder 207 and the fixing film 203 are arranged in parallel to the pressure roller 205 with fixing heater 204 sides thereof being oriented to contact with the pressure roller 205. Both end portions of the heater holder 207 are under a state of being pressed with a predetermined pressing force by an urging mechanism (not shown).

With this, a surface of the fixing heater 204 is held in press contact with the pressure roller 205 through the fixing film 203 against elasticity of the pressure roller 205, thereby forming a fixing nip portion 206 having a predetermined width. The pressure roller 205 is driven by a driving mechanism (not shown) to rotate at a predetermined peripheral speed in a direction of the arrow (counterclockwise direction). The fixing heater 204 is constructed by forming a resistance heating element on a ceramic board. A thermistor 208 is held in contact with the fixing heater 204. The thermistor 208 is configured to detect a temperature of the fixing heater 204. The CPU 10 controls supply of power to the fixing heater 204 so that the temperature of the fixing heater 204 is set to a predetermined temperature.

A target temperature of the fixing heater 204 is determined based on a sheet type and an environmental temperature. The CPU 10 determines the target temperature of the fixing heater 204 based on a medium type set through the operation unit 13 or a medium type detected by the medium sensor 14. At this time, when the environmental temperature is further known, the CPU 10 corrects the target temperature of the fixing heater 204 in consideration of the environmental temperature.

<Description of Medium Sensor 14>

Figure 4A:
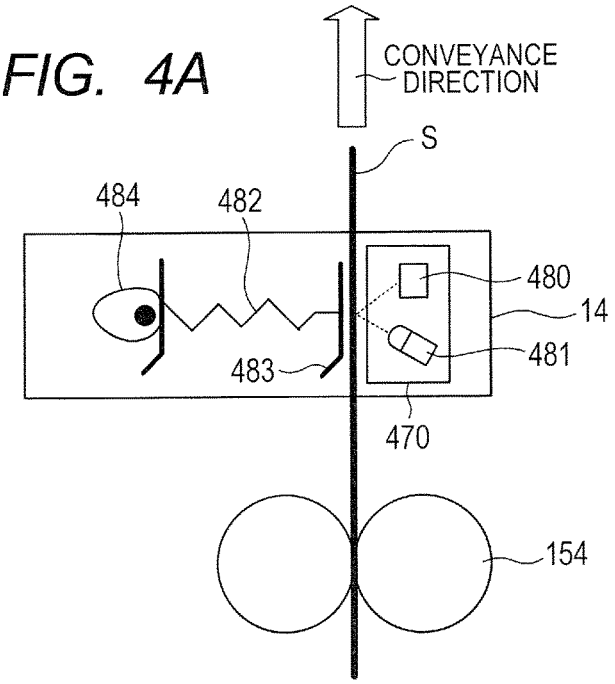
FIG. 4A is an explanatory view of a medium sensor in the first embodiment.

With reference to FIG. 4A, one example of the medium sensor 14 is described. The medium sensor 14 includes a sensor unit 470. In the sensor unit 470, there are arranged an LED 481 being a light-emitting element and a photodiode 480 being a light-receiving element. The photodiode 480 is configured to detect an amount of light which is irradiated from the LED 481 to an object (sheet S) and reflected from the object (reflected light amount). A guide portion 483 which receives the sheet S is pressed toward the sheet side by a spring 482 being a pressing member. A pressing force of the spring 482 is changed by a cam 484 which is rotated by a driving unit (not shown). When the cam 484 is rotated in a direction of decreasing an effective length of the spring 482, the pressing force of the spring 482 against the guide portion 483 is strong. When the cam 484 is rotated in a direction of increasing the effective length of the spring 482, the pressing force of the spring 482 against the guide portion 483 is weak. While the medium sensor 14 detects the quality of material of the sheet S, the cam 484 is driven to rotate to change the pressing force of the spring 482.

Figure 4B:
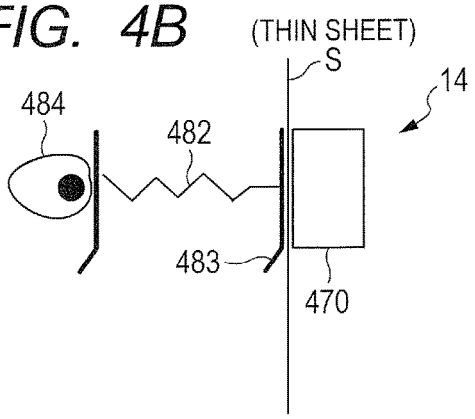
FIG. 4B is a schematic view for illustrating a state in which a pressing force of a spring 482 is weak during conveyance of a thin sheet.
Figure 4C:
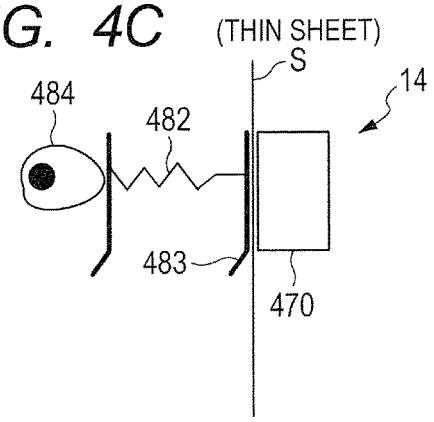
FIG. 4C is a schematic view for illustrating a state in which the pressing force of the spring 482 is strong during conveyance of the thin sheet.
Figure 4D:
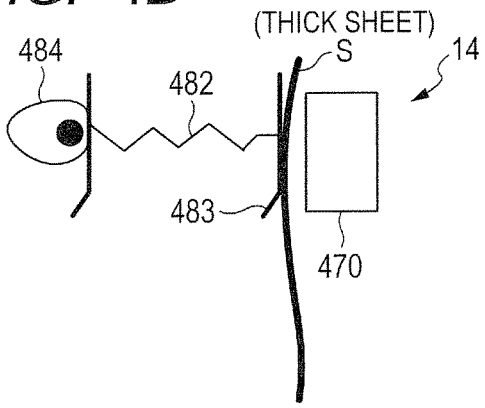
FIG. 4D is a schematic view for illustrating a state in which the pressing force of the spring 482 is weak during conveyance of a thick sheet.
Figure 4E:
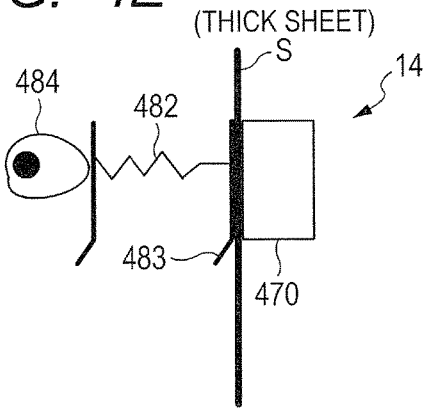
FIG. 4E is a schematic view for illustrating a state in which the pressing force of the spring 482 is strong during conveyance of the thick sheet.

FIG. 4B to FIG. 4E are schematic views for illustrating, as one example, states in which a thin sheet and a thick sheet are conveyed. FIG. 4B is an illustration of a state in which the pressing force of the spring 482 is weak during the conveyance of the thin sheet. FIG. 4C is an illustration of a state in which the pressing force of the spring 482 is strong during the conveyance of the thin sheet. In the case where the thin sheet is conveyed, the thin sheet is stably conveyed with respect to the guide portion 483 irrespective of the pressing force of the spring 482. FIG. 4D is an illustration of a state in which the pressing force of the spring 482 is weak during the conveyance of the thick sheet. FIG. 4E is an illustration of a state in which the pressing force of the spring 482 is strong during the conveyance of the thick sheet. Under a state in which the pressing force of the spring 482 is weak, the thick sheet having high stiffness pushes the guide portion 483. Under a state in which the pressing force of the spring 482 is strong, the sheet S being the thick sheet is pressed against the sensor unit 470 through the guide portion 483 by the pressing force of the spring 482, and is stably conveyed.

Figure 5A:
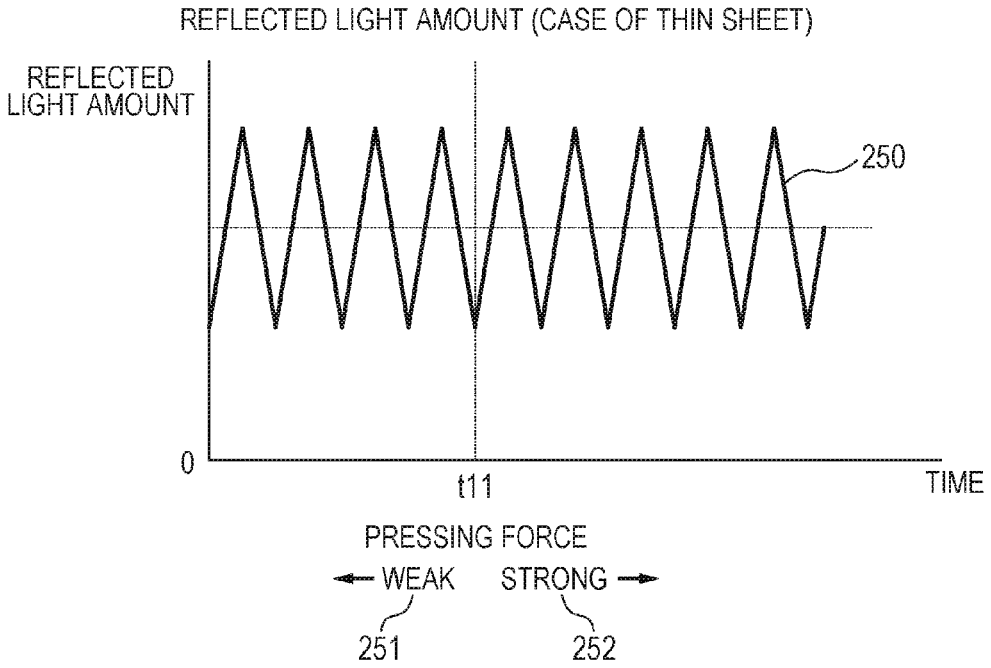
FIG. 5A is an explanatory graph for showing a reflected light amount when a sheet S is a thin sheet.
Figure 5B:
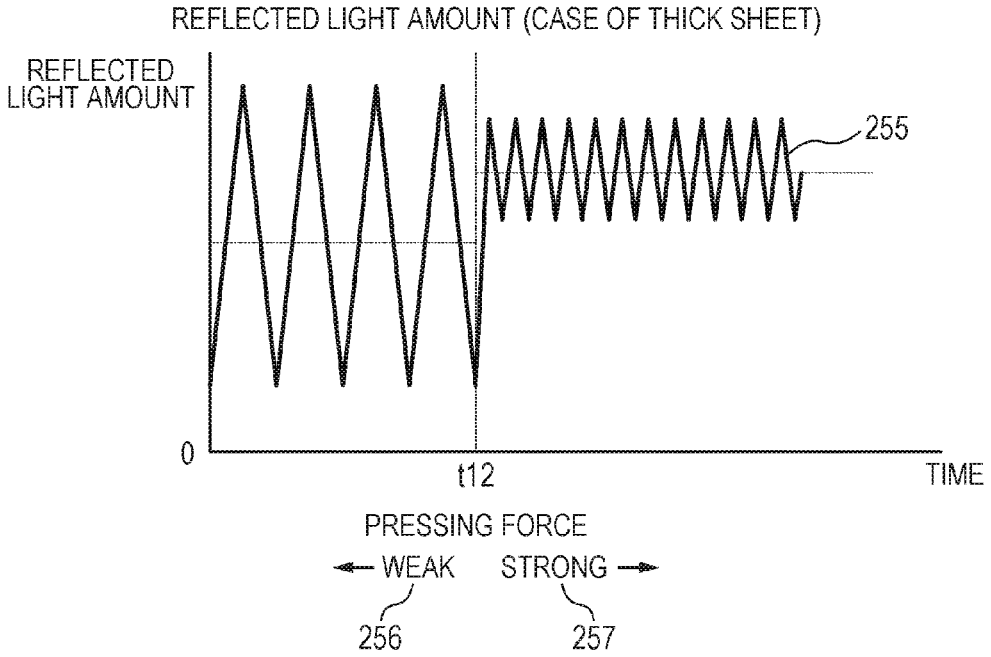
FIG. 5B is an explanatory graph for showing the reflected light amount when the sheet S is a thick sheet.

In FIG. 5A, illustration is made of a plot 250 of a reflected light amount which can be obtained by the photodiode 480 when the sheet S is the thin sheet. In FIG. 5B, illustration is made of a plot 255 of a reflected light amount which can be obtained by the photodiode 480 when the sheet S is the thick sheet. In FIG. 5A and FIG. 5B, the horizontal axis represents time, and the vertical axis represents the reflected light amount obtained by the photodiode 480. At timings t11 and t12, the pressing force of the spring 482 is changed from a weak state (FIG. 4B and FIG. 4D) to a strong state (FIG. 4C and FIG. 4E). When the sheet S is the thin sheet, the sheet S is stably conveyed along the guide portion 483 irrespective of the pressing force of the spring 482 (weak 251 and strong 252). Therefore, there is no change in an average value of the reflected light amount and a magnitude of a difference between a maximum value and a minimum value of the reflected light amount (hereinafter referred to as amplitude) before and after the timing t11 (plot 250).

When the sheet S is the thick sheet, and the pressing force of the spring 482 is changed from a weak state (weak 256) to a strong state (strong 257) at the timing t12, an average value of the reflected light amount becomes larger, and an amplitude of the reflected light amount becomes smaller (plot 255), as compared to those of the state in which the pressing force of the spring 482 is weak. When the sheet is the thick sheet, the average value and the magnitude of the amplitude of the reflected light amount change in accordance with the pressing force of the spring 482. This is because the sheet S is not stably conveyed along the guide portion 483 when the pressing force of the spring 482 is weak (weak 256), whereas the sheet S is stably conveyed along the guide portion 483 when the pressing force of the spring 482 is strong (strong 257).

The CPU 10 receives an input signal from the photodiode 480 as an output value of the medium sensor 14. The CPU 10 discriminates a sheet type of the sheet S based on the reflected light amount detected by the medium sensor when the spring 482 presses the sheet S with a predetermined force and based on the reflected light amount detected by the medium sensor 14 when the spring 482 presses the sheet S with a force larger than the predetermined force. For each sheet S, the CPU 10 discriminates a sheet type of the sheet (quality of material or thickness of the sheet S) being conveyed based on the output value of the medium sensor 14. The CPU 10 optimally controls the temperature of the fixing device 170 in accordance with the discriminated sheet type based on the detection result given by the medium sensor 14. Further, the CPU 10 stores the discriminated sheet type in the storage unit 15. When a plurality of sheet accommodating units are provided, the CPU 10 may store information of a sheet type for each sheet accommodating unit in the storage unit 15.

The medium sensor 14 described in this embodiment is arranged on the conveyance path, and is configured to detect a sheet type when the sheet S passes through a position opposed to the medium sensor 14. When the sheet type detected by the medium sensor 14 is different from the sheet type set through the operation unit 13, the CPU 10 stops the conveyance of the sheet S. In this case, a user needs to remove the stopped sheet S. After the sheet is removed by the user, the CPU 10 needs to restart the image forming operation.

One example of the configuration of the medium sensor 14 used in this embodiment is described above. The configuration of the medium sensor 14 described in this embodiment is one example, and the present invention is not limited to this configuration. For example, it is also effective to employ a method of using an ultrasonic sensor such as a piezoelectric element in combination with the light-emitting element and the light-receiving element described in this embodiment. In the case of such a configuration, a basis weight of a sheet can be detected through use of a received signal of the ultrasonic sensor, thereby being capable of discriminating a sheet type with higher accuracy. The present invention is still effective even with the medium sensor 14 having other configurations.

<Automatic Detection Mode and Instruction Mode>

(Automatic Detection Mode)

Figure 6A:
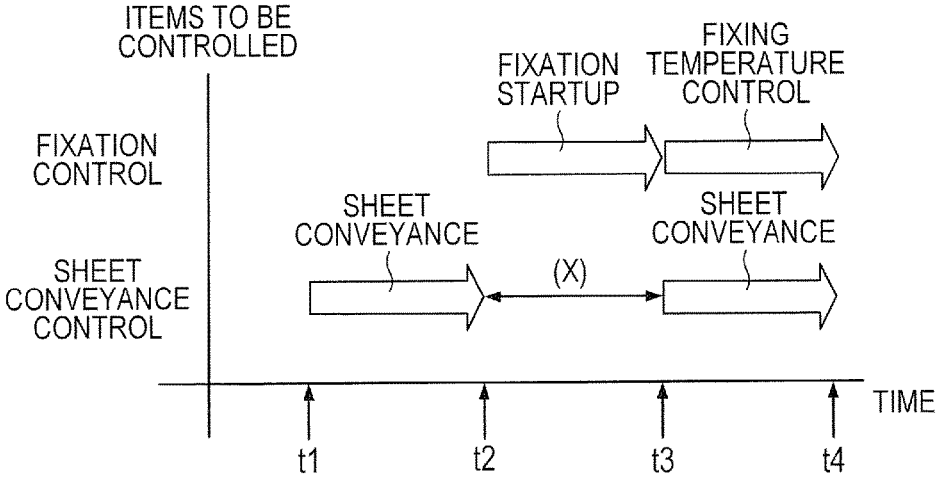
FIG. 6A is an explanatory diagram for illustrating an automatic detection mode in the first embodiment.
Figure 6B:
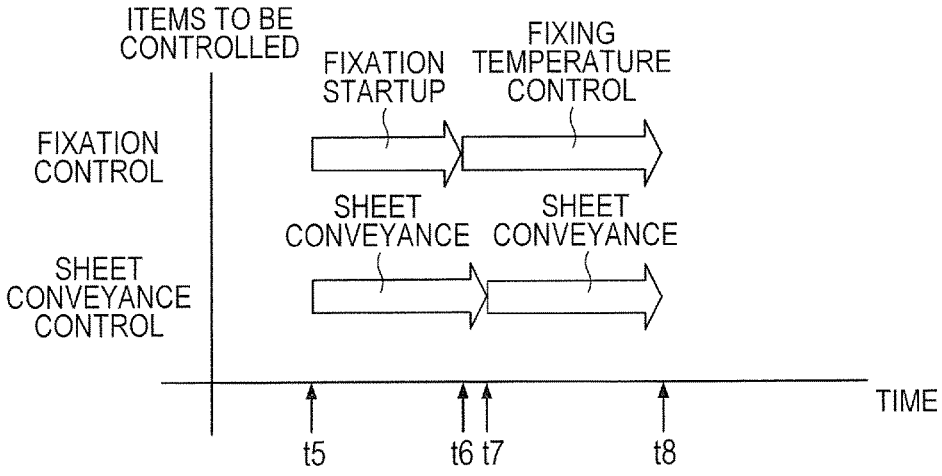
FIG. 6B is an explanatory diagram for illustrating an instruction mode in the first embodiment.

With reference to FIG. 6A and FIG. 6B, an automatic detection mode being a second mode of this embodiment and an instruction mode being a first mode of this embodiment are described. In FIG. 6A and FIG. 6B, the horizontal axis represents time, which includes timings of events such as starting of the printing operation, which occur in the image forming apparatus 100, and a timing at which the sheet arrives at the medium sensor 14. In FIG. 6A and FIG. 6B, the vertical axis represents items to be controlled such as a fixation control and a sheet conveyance control.

With reference to FIG. 6A, description is made of an operation when the automatic detection mode is set through the operation unit 13. When the operation start instruction is input through the operation unit 13 at a timing t1, the CPU 10 starts the sheet conveyance control. At this time, an actual sheet type is unknown. Thus, a control with respect to the fixing device 170 is not started. After that, the CPU 10 monitors the sheet-feeding pickup sensor 152 and waits until a sheet arrives at the medium sensor 14. Then, after a leading edge of the sheet arrives at the medium sensor 14 at a timing t2, the CPU 10 discriminates a sheet type of the conveyed sheet based on a detection result given by the medium sensor 14. After the discrimination of the sheet type through use of the medium sensor 14 is terminated, the CPU 10 determines a target temperature with respect to the fixing device 170 in accordance with the discriminated sheet type and starts a fixation startup control.

When it is determined that the temperature of the fixing device 170 is lower than the target temperature when the fixation startup control is started, and the temperature does not reach the target temperature before the sheet arrives at the fixing nip portion 206 of the fixing device 170, the CPU 10 temporarily stops the conveyance of the sheet at the position of the registration rollers 161 (timing t2). The CPU 10 waits until the temperature of the fixing device 170 reaches the target temperature ((X) of FIG. 6A). Then, at a timing t3 at which the temperature of the fixing device 170 has reached the target temperature, the CPU 10 performs the sheet conveyance control of driving a motor to restart the conveyance of the sheet. Further, the CPU 10 performs the fixing temperature control of maintaining the temperature of the fixing device 170 at the target temperature. After the sheet arrives at the fixing device 170 at a timing t4, fixing processing is performed.

In the automatic detection mode, a user does not need to be aware of or select a sheet type. Meanwhile, the fixation startup operation cannot be started until the sheet type is identified, with the result that a timing of termination of image formation delays. There is a method of setting ahead the fixation startup control during the automatic detection mode based on a detection result of the medium sensor 14 in the past. However, the sheet type is uncertain immediately after the sheet-feeding cassette 220 is opened or closed, and immediately after the image forming apparatus 100 is turned on. In such a state, the fixation startup operation of the fixing device 170 cannot be started until the sheet type is ascertained. Also in this case, there is a fear in that termination of the image formation delays.

(Instruction Mode)

With reference to FIG. 6B, description is made of a case where the instruction mode is set through the operation unit 13. When the sheet type is selected through the operation unit 13 at a timing t5, and the operation start instruction is input, the CPU 10 starts the sheet conveyance operation. The sheet type is selected at the timing t5, and hence the target temperature with respect to the fixing device 170 is ascertained at this point of time. Thus, the CPU 10 starts the sheet conveyance operation together with the startup operation with respect to the fixing device 170 at the timing t5. The CPU 10 monitors the conveyance sensor such as the sheet-feeding pickup sensor 152 and monitors the thermistor 208.

Illustration is made of an example in which the thermistor 208 detects that the detected temperature has reached the target temperature at a timing t6, and the leading edge of the sheet has arrived at the medium sensor 14 at a timing t7. When the sheet has arrived at the medium sensor 14 after the temperature of the fixing device 170 has reached the target temperature, the CPU 10 can continue the operation without stopping the conveyance of the sheet due to temperature factors at the timing at which the discrimination of the sheet type through use of the medium sensor 14 is terminated. This is because the temperature of the fixing device 170 has already reached the target temperature at a timing t8 at which the sheet arrives at the fixing device 170. Thus, in the instruction mode, the waiting time (X) as in the automatic detection mode (FIG. 6A) does not occur. Therefore, the time period from the start of the printing operation (timing t5) to the delivery of the sheet can be shortened.

In the instruction mode, even though a user needs to be aware of or select a sheet type, the fixation startup operation can be performed at an earliest timing. With this, the image formation can be terminated at an earliest timing.

The image forming apparatus 100 of this embodiment includes both the automatic detection mode and the instruction mode. Thus, the image forming apparatus 100 can cope with a user who would not like to perform the operation of consciously setting the sheet type. Although a user needs to consciously set the sheet type, the image forming apparatus 100 can cope with a user who requires a product at an earliest timing.

The above-mentioned embodiment is one example, and the present invention is not limited thereto. For example, selection of the automatic detection mode or the instruction mode can be set through a personal computer having a printer driver, which is other than the operation unit 13. Further, in the above-mentioned embodiment, the fixation startup control is exemplarily described as a factor causing the problem in that the timing of termination of image formation delays in the automatic detection mode. However, the present invention is not limited thereto. Any control which requires time for a preparatory operation for the image forming operation may cause the similar problem. For example, any image forming apparatus which requires an operation of ascertaining a voltage value of a voltage to be applied to the secondary transfer portion 140 in accordance with a sheet type may have the similar problem.

<Description of Flowchart for Discrimination of Erroneous Instruction as to Sheet Type>

Next, with reference to the flowchart of FIG. 7, description is made of a method of determining that a sheet type set before starting the sheet-feeding operation and a sheet type detected by the medium sensor 14 do not match (hereinafter referred to as sheet type mismatch), as the feature of this embodiment. Through the operation unit 13, a user selects the instruction mode, performs selection of a sheet type of a sheet to be conveyed, and inputs the operation start instruction. Then, the CPU 10 starts operations subsequent to Step (hereinafter abbreviated to "S") 300. In S300, the CPU 10 starts a print job in the instruction mode. In S301, the CPU 10 obtains the sheet type set by a user.

(Case where Detection Result given by Medium Sensor is Stored in Storage Unit)

In S302, the CPU 10 determines whether or not a sheet detection result given by the medium sensor 14 is stored in the storage unit 15. When it is determined in S302 that the sheet detection result is stored in the storage unit 15, the CPU 10 advances the processing to S303. In S303, the CPU 10 determines whether or not the sheet type obtained in S301 and the sheet detection result stored in the storage unit 15, in other words, detection result in the past match with each other. When it is determined in S303 that the sheet type set through the operation unit 13 and the sheet detection result stored in the storage unit 15 do not match with each other, the CPU 10 advances the processing to S312.

In this case, there is a possibility that the sheet type set by a user and the sheet type detected by the medium sensor 14 in the past, in other words, sheet type of a sheet in the sheet-feeding cassette 220 do not match with each other. In S312, the CPU 10 controls the operation unit 13 to display a message which indicates that there is a possibility of error in the setting by a user to notify the user, and terminates the processing. As described above, the operation unit 13 also serves as a notification unit. FIG. 8A is an illustration of an example of a screen to be displayed by the operation unit 13. The screen as illustrated in FIG. 8A is displayed by the operation unit 13 to prompt a user to check the setting of the sheet type and a sheet in the sheet-feeding cassette 220. In this case, the CPU 10 does not start operations of the sheet-feeding motor 150 and the image forming unit 17 (printing operation).

Through the above-mentioned operations, when the instruction mode is set, and the detection result given by the medium sensor 14 is stored in the storage unit 15, the sheet type mismatch can be determined before the sheet-feeding operation by the sheet-feeding motor 150 is performed. As a result, there is no need to perform the operation of removing the sheet stopped on the conveyance path, which is required when the determination of the sheet type mismatch is given after the start of sheet feeding. Thus, usability is improved.

When it is determined in S303 that the detection result stored in the storage unit 15 and the sheet type set by a user match with each other, the CPU 10 advances the processing to S305. In S305, the CPU 10 starts processing of shifting from a standby state of the fixation control and the high voltage control to the printing state in accordance with the sheet type set by a user (hereinafter referred to as pre-rotation processing), and thereafter starts the printing operation such as the sheet-feeding operation and the image forming operation. In S306, the CPU 10 controls the medium sensor 14 to perform a sheet detection operation for each page of sheets to discriminate a sheet type of a sheet being conveyed. With this, the image forming apparatus 100 can cope with the case where a sheet of a different sheet type is erroneously mixed in sheets in the sheet-feeding cassette 220. Further, the CPU 10 stores, in the storage unit 15, information of the reflected light amount detected by the medium sensor 14. The CPU 10 may also store, in the storage unit 15, information related to the sheet type discriminated based on the reflected light amount detected by the medium sensor 14. In this embodiment, the reflected light amount detected by the medium sensor 14 is stored in the storage unit 15.

In S308, the CPU 10 determines whether or not the sheet type set by a user and the sheet type discriminated based on the detection result given by the medium sensor 14 in S306 match with each other. When it is determined in S308 that the sheet type set by a user and the discrimination result of the sheet type given by the medium sensor 14 do not match with each other, the CPU 10 advances the processing to S309. In S309, the CPU 10 stops the conveyance of the sheet and stops the printing operation. In S313, the CPU 10 controls the operation unit 13 to display a massage to notify that a sheet of a different type is mixed in the sheet-feeding cassette 220, and terminates the processing. One example of a screen to be displayed on the operation unit 13 in S313 is illustrated in FIG. 8B. For example, the CPU 10 controls the operation unit 13 to display the fact that the printing is stopped and the fact that the sheet type is changed, thereby prompting a user to check the setting of the sheet type or to check the sheet in the sheet-feeding cassette 220.

When it is determined in S308 that the sheet type set by a user and the discrimination result of the sheet type given by the medium sensor 14 match with each other, the CPU 10 continues the operation and determines whether or not the sheet is a final page in S310. When it is determined in S310 that the sheet is the final page, the CPU 10 terminates printing in S311 and terminates the processing. When it is determined in S310 that the sheet is not the final page, the CPU 10 returns the processing to S306.

(Case where Detection Result given by Medium Sensor is not Stored in Storage Unit)

Figure 7:
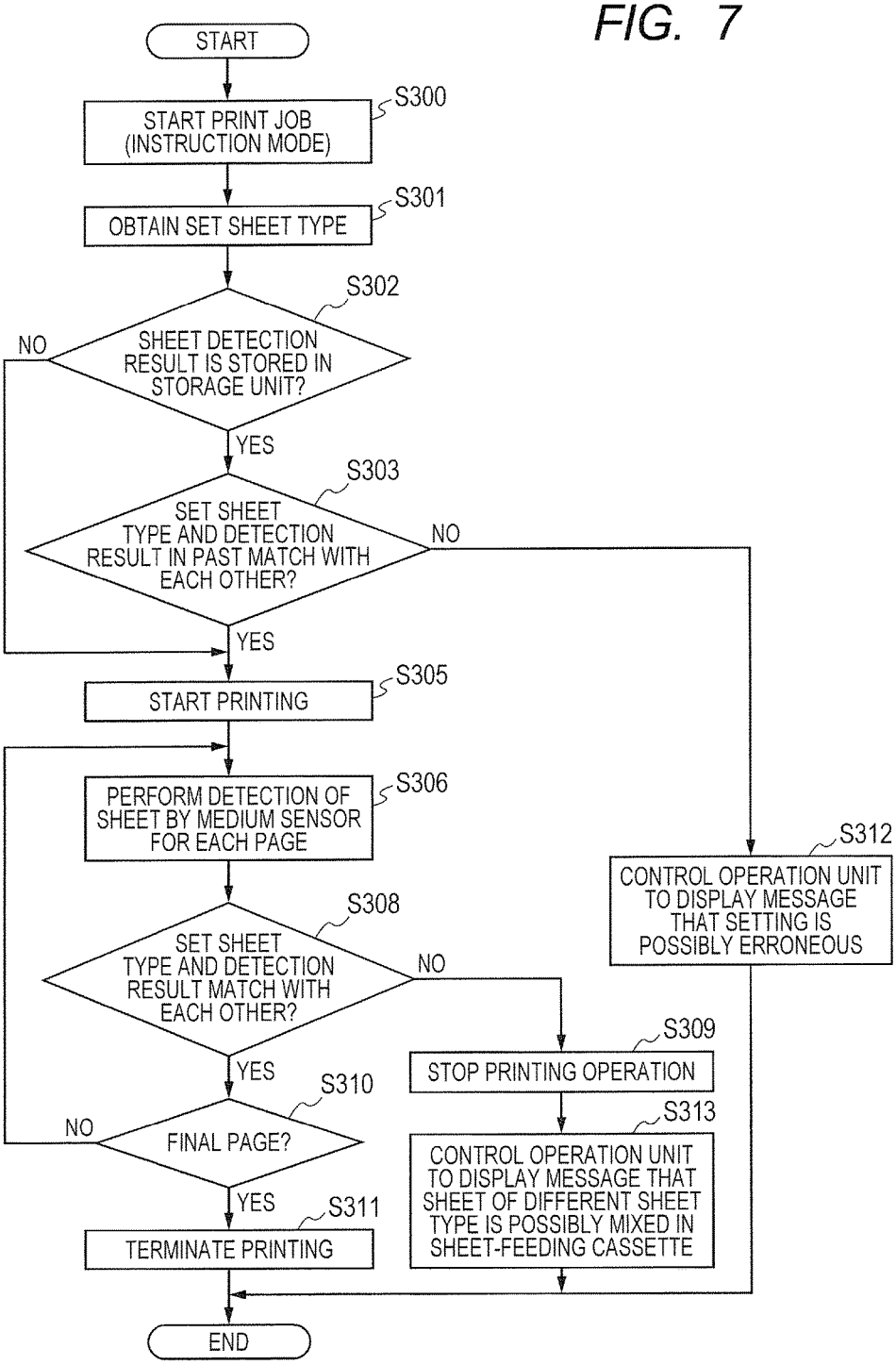
FIG. 7 is a flowchart for illustrating a print control in the first embodiment.

With reference to the flowchart of FIG. 7, description is made of operations in the case where the instruction mode is selected and where the detection result given by the medium sensor 14 is not stored in the storage unit 15. When it is determined in S302 that the detection result given by the medium sensor 14 is not stored in the storage unit 15, the CPU 10 advances the processing to S305. In S305, the CPU 10 starts printing after execution of the pre-rotation processing, and waits until the sheet conveyed by the sheet-feeding pickup roller 151 arrives at the medium sensor 14. When the sheet arrives at the medium sensor 14, the CPU 10 starts discrimination processing for the sheet type through use of the medium sensor 14 in S306. The processing subsequent to S308 is described above, and hence description thereof is omitted.

When the sheet type detection result is not stored in the storage unit 15, and it is determined in the processing of S308 that the sheet type set by a user and the sheet type discriminated by the medium sensor 14 do not match with each other, the CPU 10 stops the printing operation in S309. In this case, that is, in a case of discriminating the sheet type by the medium sensor 14 and stopping the printing operation, it is necessary to remove the sheet stopped on the conveyance path.

In the above, according to this embodiment, usability can be improved even in the case where the sheet type which has been set and the sheet type stored in the memory unit do not match with each other.

Second Embodiment

Figure 9A:
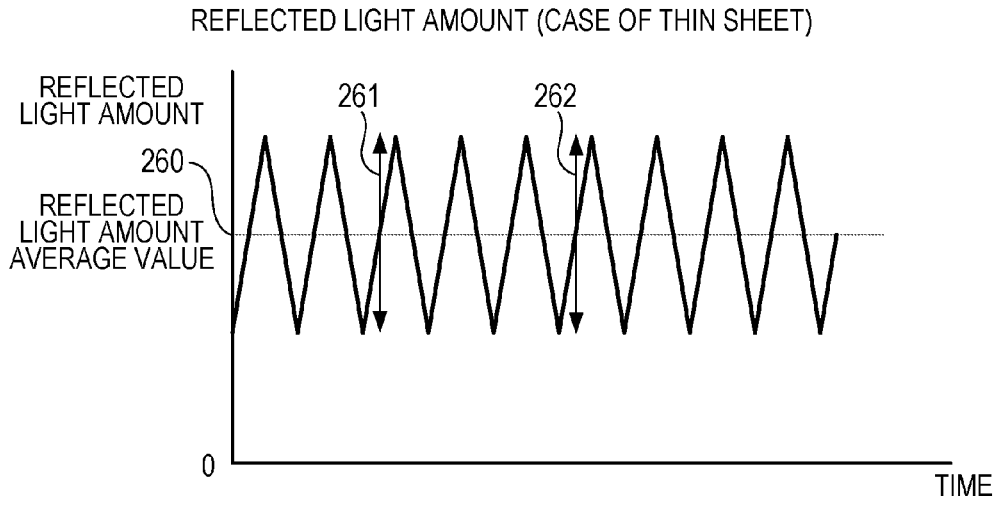
FIG. 9A is an explanatory graph for showing the reflected light amount when the sheet S is a thin sheet.
Figure 9B:
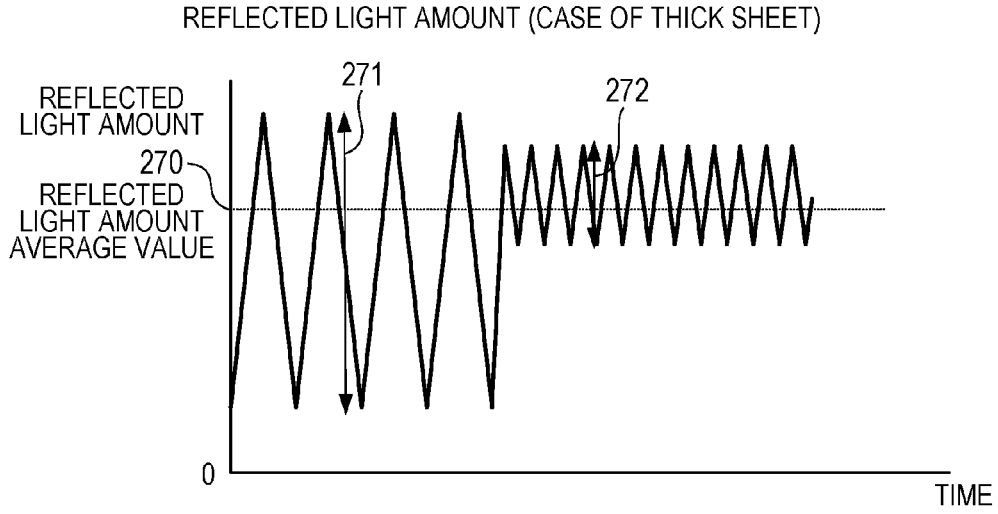
FIG. 9B is an explanatory view for illustrating the reflected light amount when the sheet S is a thick sheet.

With reference to FIG. 9A, FIG. 9B, FIG. 10A, and FIG. 10B, description is made of a second embodiment of the present invention. The CPU 10 detects an input signal from the photodiode 480, and calculates an average value and a magnitude of fluctuation of the reflected light amount based on the detected input signal. In FIG. 9A and FIG. 9B, the horizontal axis and the vertical axis are the same as those of FIG. 5A and FIG. 5B, and hence description thereof is omitted. In the example of the thin sheet in FIG. 9A, an average value 260 is the value shown in FIG. 9A. The magnitude of fluctuation of the reflected light amount is represented by, among differences between a maximum value and a minimum value of each cycle of the input signal from the photodiode 480 (hereinafter referred to as amplitude), a difference between a maximum amplitude and a minimum amplitude. In the example of the thin sheet shown in FIG. 9A, the amplitude of the reflected light amount is uniform. Thus, for example, the magnitude of fluctuation which is the difference between the amplitude 261 and the amplitude 262 is zero or an extremely small value.

In the example of the thick sheet shown in FIG. 9B, an average value 270 of the reflected light amount is the value shown in FIG. 9B. As compared to the average value 260 of the reflected light amount in the case of the thin sheet, the average value 270 is slightly larger. The magnitude of fluctuation is a difference between an amplitude 271 and an amplitude 272 in the case of the thick sheet shown in FIG. 9B. In the case of the thick sheet, the variation of the reflected light amount is larger as compared to the variation of the reflected light amount in the case of the thin sheet.

<Reflected Light Amount and Sheet Type>

Figure 10A:
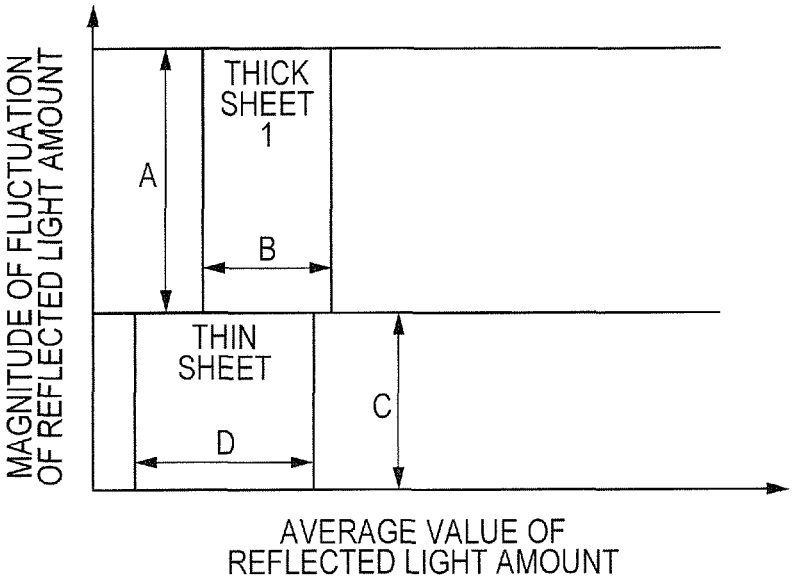
FIG. 10A is a diagram for illustrating a relationship between the reflected light amount and sheet types.

Description is made of a relationship between an input signal value from the photodiode 480, that is, the reflected light amount and the sheet type. FIG. 10A is an illustration of the relationship between the reflected light amount and the sheet type. The horizontal axis represents an average value of the reflected light amount, and the vertical axis represents a magnitude of fluctuation of the reflected light amount. As illustrated in FIG. 10A, a sheet defined as a thick sheet 1 is a sheet having an average value of the reflected light amount within a range B illustrated in FIG. 10A, and a magnitude of fluctuation of the reflected light amount within a range A illustrated in FIG. 10A. A sheet defined as a thin sheet is a sheet having an average value of the reflected light amount within a range D illustrated in FIG. 10A, and a magnitude of fluctuation of the reflected light amount within a range C illustrated in FIG. 10A. The CPU 10 discriminates a sheet type based on the reflected light amount detected by the medium sensor 14. Values indicating the ranges B and D of the average value of the reflected light amount and the values indicating the ranges A and C of the magnitude of fluctuation of the reflected light amount are stored in advance in the ROM 11. The CPU 10 detects an input signal from the photodiode 480 when a sheet passes through the medium sensor 14, and calculates an average value and a magnitude of fluctuation of the reflected light amount. With this, the CPU 10 discriminates a sheet type of a sheet being conveyed. The CPU 10 optimally controls the temperature of the fixing device 170 in accordance with the sheet type discriminated based on the detection result given by the medium sensor 14. Further, the CPU 10 stores the discriminated sheet type in the storage unit 15. When a plurality of sheet accommodating units are provided, the CPU 10 may store, in the storage unit 15, information of a sheet type for each sheet accommodating unit.

<Case where Sheet Type is not Uniquely Determined>

In the market, sheets of a wide variety of types are available. Depending on the environment in which the image forming apparatus 100 is to be installed, sheet conditions such as the amount of moisture to be absorbed by a sheet may vary. Thus, there exists a case where a sheet type cannot be uniquely specified by the detection result given by the medium sensor 14. Now, description is made of a method of determining the sheet type mismatch in consideration of the case where the sheet type cannot be uniquely specified.

Figure 10B:
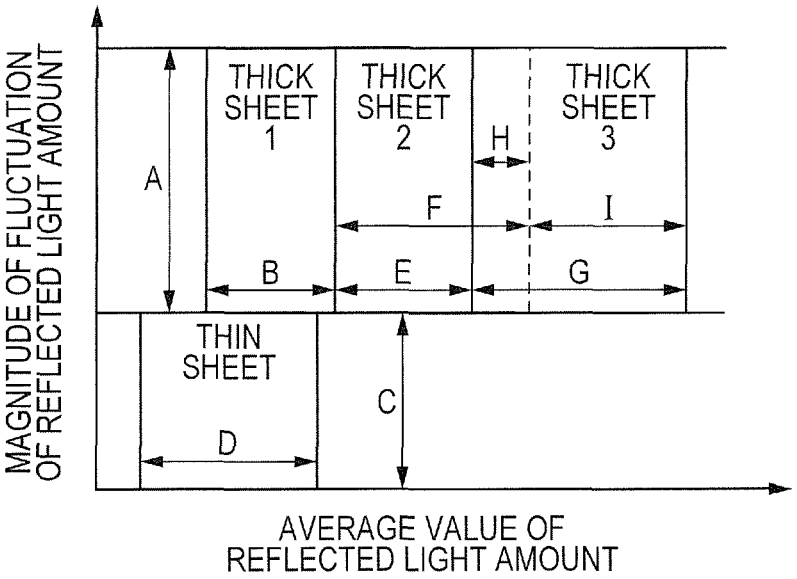
FIG. 10B is a diagram for illustrating a relationship between the reflected light amount and the sheet types.

FIG. 10B is an illustration of a relationship between a reflected light amount and a sheet type. The horizontal axis and the vertical axis of FIG. 10B are the same as those of FIG. 10A, and hence description thereof is omitted. As one example, description is made of a case where sheets of types including a thick sheet 2 and a thick sheet 3 are used as sheets having a larger basis weight than that of the thick sheet 1. A range of an average value of the reflected light amount for discrimination of the thick sheet is a range F illustrated in FIG. 10B. A range of an average value of the reflected light amount for discrimination of the thick sheet 3 is a range G illustrated in FIG. 10B. In this case, a region H illustrated in FIG. 10B falls within both the range F for discrimination of the thick sheet 2 and the range G for discrimination of the thick sheet 3. Thus, when the average value of the reflected light amount based on the detection result given by the medium sensor 14 is a value within the range H, there is a possibility that a sheet is discriminated as the thick sheet 2 and the thick sheet 3. Therefore, a sheet type cannot be uniquely specified. In other words, there is a case where a plurality of candidates of sheet types are given as a result of discrimination of a sheet type based on the detection result given by the medium sensor 14. There exist sheets of a wide variety of sheet types, and conditions of the sheets may also vary. Therefore, there is a case where regions for discrimination of the sheet type may overlap for a certain sheet. With regard to the fixation control for a sheet within the region H illustrated in FIG. 10B, for example, an average value of a target fixing temperature for the thick sheet 2 and a target fixing temperature for the thick sheet 3 may be calculated to set the average value as a target value.

Figure 11:
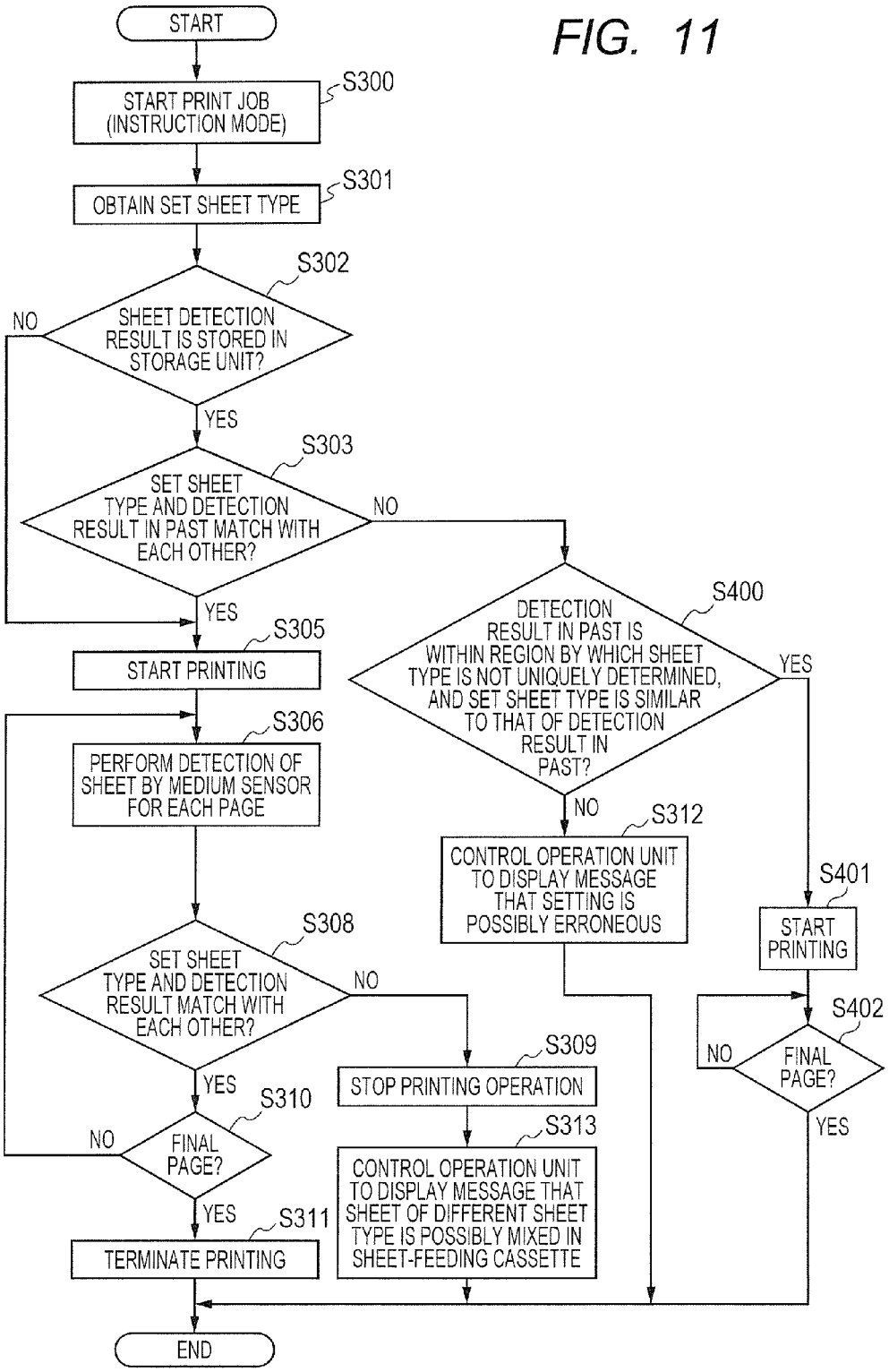
FIG. 11 is a flowchart for illustrating a print control in a second embodiment of the present invention.

Now, description is made of a method of discriminating the sheet type mismatch in consideration of a case where a sheet type cannot be uniquely specified based on a detection result given by the medium sensor 14 due to occurrence of the overlap of regions for discrimination of a sheet type as in the case of the thick sheet 2 and the thick sheet 3 of FIG. 10B. FIG. 11 is a flowchart for illustrating processing of determining the sheet type mismatch in the case where the sheet type cannot be uniquely specified. Processing steps which are the same as those of the flowchart illustrated in FIG. 7 are denoted by the same step numbers, and description thereof is omitted.

When the sheet type set by a user and a sheet type stored in the storage unit 15 do not match with each other in S303, the CPU 10 advances the processing to S400. In S400, the CPU 10 determines whether or not the sheet detection result stored in the storage unit 15 falls within the region H of FIG. 10B by which the sheet type is not uniquely determined, and the sheet type set by a user is a similar sheet type to that of the sheet detection result stored in the storage unit 15. Herein, the similar sheet type represents that, for example, as in the case of the thick sheet 2 and the thick sheet 3 of FIG. 10B, property information, for example, an average value of the reflected light amount of the sheet, is approximated. The thick sheet 1 and the thick sheet 3 of FIG. 10B are not approximated in sheet property information, and are not of similar sheet types. For example, based on the sheet detection result stored in the storage unit 15, the sheet is discriminated as a thick sheet based on the magnitude of fluctuation of the reflected light amount. However, when the average value of the reflected light amount is included in the region H of FIG. 10B, it cannot be specified whether the sheet type is the thick sheet 2 or the thick sheet 3. In this case, when the set sheet type is the thick sheet 2 or the thick sheet 3, the set sheet type is a similar sheet type to that of the sheet detection result stored in the storage unit 15. Meanwhile, when the set sheet type is the thick sheet 1, the set sheet type is not of a similar sheet type to that of the sheet detection result stored in the storage unit 15.

In S400, when the detection result in the past falls within a region by which the sheet type cannot be uniquely determined and it cannot be determined that the sheet type set by a user is a similar sheet type to that of the detection result in the past, the CPU 10 advances the processing to S312. In S312, the CPU 10 controls the operation unit 13 to display and notify that the setting by a user may be erroneous, and terminates the processing.

In S400, when the detection result in the past falls within the region by which the sheet type is not uniquely determined and it is determined that the sheet type set by a user is a similar sheet type to that of the detection result in the past, the CPU 10 advances the processing to S401. In this case, the detection result given by the medium sensor 14 is included in the region H. Thus, a plurality of candidates are provided, and the sheet type cannot be uniquely determined. Therefore, the accuracy of the detection result is low. When it cannot be ascertained that the sheet type belongs to which of the plurality of candidates, the CPU 10 starts the printing operation and the sheet-feeding operation in S401. In this case, the CPU 10 determines image forming conditions based on the sheet type set by the user. Further, in this case, the detection of a sheet during the printing operation as in the processing of S306 is not performed. In S402, the CPU 10 determines whether or not a page subjected to printing is a final page. When it is determined that the page is not the final page, the CPU 10 returns the processing to S402. When it is determined that the page is the final page, the CPU 10 terminates the processing. When the detection result given by the medium sensor 14 in S306 falls within the region by which the sheet type cannot be uniquely determined, the fact is stored in the storage unit 15.

In the above, description is made of a method of determining the sheet type mismatch before the start of the sheet-feeding operation in consideration of the case where the sheet type cannot be uniquely specified. Through the operation described above, the printing operation can be continued without stopping in the case where the sheet type cannot be uniquely determined based on the detection result given by the medium sensor 14. The sheet type mismatch can be accurately determined before the sheet-feeding operation by the sheet-feeding motor 150 in the case where the sheet type can be uniquely determined based on the detection result given by the medium sensor 14.

The above-mentioned example is one example, and the present invention is not limited thereto. In this embodiment, description is made, as one example, the case where the overlap occurs in the regions of the average values of the reflected light amount. However, the control can be similarly performed also in the case where the overlap occurs in the regions of the magnitudes in variation of the reflected light amount. Also when another method of detecting the sheet type is used, the control can be performed similarly when the sheet type is not uniquely determined.

In the above, according to this embodiment, usability can be improved even in the case where the sheet type which has been set and the sheet type stored in the memory unit do not match with each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-062452, filed Mar. 25, 2016, and Japanese Patent Application No. 2016-062453, filed Mar. 25, 2016, which are hereby incorporated by reference herein in their entirety.

What is claimed is:

1. An image forming apparatus, comprising:

a sheet accommodating unit in which a sheet is to be accommodated;

a feeder configured to feed a sheet stacked on the sheet accommodating unit;

a detector configured to detect a material type of the sheet fed by the feeder;

a setting unit configured to set manually a material type of the sheet stacked in the accommodating unit;

a memory configured to store information related to a material type detected by the detector in the past; and a controller configured to control a printing operation in any one of a first mode of controlling the printing operation based on a set material type and a second mode of controlling the printing operation based on a detection result given by the detector, and the controller configured to control the feeder so as to prevent feeding of a sheet from starting, when the printing operation is started in the first mode, in a case that the material type set by the setting unit and a material type discriminated based on the information stored in the memory do not match with each other prior to detection by the detector.

2. An image forming apparatus according to claim 1, further comprising a notification unit configured to notify information, wherein the controller controls the notification unit to notify that the set material type and a material type of a sheet accommodated on the sheet accommodating unit do not match with each other.

3. An image forming apparatus according to claim 1, wherein, when the set material type and a discriminated material type match with each other, the controller controls the feeder to start feeding of a sheet from the sheet accommodating unit, controls the detector to detect a material type of the sheet fed from the sheet accommodating unit, and stores a detection result given by the detector in the memory.

4. An image forming apparatus according to claim 3, wherein, when the set material type and a detected material type do not match with each other, the controller stops the printing operation with respect to the fed sheet.

5. An image forming apparatus according to claim 4, further comprising a notification unit configured to notify information, wherein the controller controls the notification unit to notify that a sheet which is a material type which is different from the set material type is possibly stacked in the sheet accommodating unit.

6. An image forming apparatus according to claim 1, wherein the detector includes:

a light-emitting element configured to irradiate light to a sheet fed by the feeder; and a light-receiving element configured to detect a light amount of the light which is reflected from the sheet by irradiating the light from the light-emitting element to the sheet.

7. An image forming apparatus according to claim 6, wherein the detector includes a pressing member configured to press a sheet toward a side on which the light-emitting element and the light-receiving element are arranged, and wherein the controller discriminates a material type based on a reflected light amount which is detected when the sheet is pressed by the pressing member with a predetermined force and a reflected light amount which is detected when the sheet is pressed by the pressing member with a force larger than the predetermined force.

8. An image forming apparatus according to claim 1, wherein, when the information related to a material type is not being stored in the memory, the controller starts the printing operation in accordance with the set material type.

9. An image forming apparatus, comprising:

a sheet accommodating unit in which a sheet is to be accommodated;

a feeder configured to feed a sheet stacked on the sheet accommodating unit;

a detector configured to detect a material type of a sheet fed by the feeder;

a setting unit configured to set manually a material type of the sheet stacked in the sheet accommodating unit;

a memory configured to store information related to a material type detected by the detector in the past; and a controller configured to control a printing operation in any one of a first mode of controlling the printing operation based on a set material type and a second mode of controlling the printing operation based on a detection result given by the detector, and the controller configured to control the feeder so as to prevent feeding of a sheet from starting, when the printing operation is started in the first mode, in a case that the material type set by the setting unit and a material type discriminated based on the information stored in the memory do not match with each other prior to detection by the detector, and that a plurality of candidates of material types are given as a result of the discrimination based on the stored information related to a material type.

10. An image forming apparatus according to claim 9, wherein, the controller is configured to control the feeder so as to prevent feeding of a sheet from starting in a case that the plurality of candidates are given and the set material type is not included in the plurality of candidates.

11. An image forming apparatus according to claim 9, further comprising a notification unit configured to notify information, wherein the controller controls the notification unit to notify that the set material type is possibly erroneous.

12. An image forming apparatus according to claim 9, wherein, when the plurality of candidates are given and the set material type is included in the plurality of candidates, the controller starts the printing operation.

13. An image forming apparatus according to claim 9, wherein, when the set material type and a discriminated material type match with each other, the controller controls the feeder to start feeding of a sheet from the sheet accommodating unit, controls the detector to detect a material type of the sheet fed from the sheet accommodating unit, and stores a detection result given by the detector in the memory.

14. An image forming apparatus according to claim 13, wherein, when the set material type and a detected material type do not match with each other, the controller stops the printing operation with respect to the fed sheet.

15. An image forming apparatus according to claim 14, further comprising a notification unit configured to notify information, wherein the controller controls the notification unit to notify that a sheet which is a material type which is different from the set material type is possibly stacked in the sheet accommodating unit.

16. An image forming apparatus according to claim 9, wherein the detector includes:

a light-emitting element configured to irradiate light to a sheet; and a light-receiving element configured to detect a light amount of the light which is reflected from the sheet by irradiating the light from the light-emitting element to the sheet.

17. An image forming apparatus according to claim 16, wherein the detector includes a pressing member configured to press a sheet toward a side on which the light-emitting element and the light-receiving element are arranged, and wherein the controller discriminates a material type based on a first reflected light amount which is detected when the sheet is pressed by the pressing member with a predetermined force and a second reflected light amount which is detected when the sheet is pressed by the pressing member with a force larger than the predetermined force.

18. An image forming apparatus according to claim 17, wherein the detector discriminates a material type based on an average value of the first reflected light amount and the second reflected light amount and magnitudes in variation of the first reflected light amount and the second reflected light amount.

19. An image forming apparatus according to claim 9, wherein, when the information related to a material type is not being stored in the memory, the controller starts the printing operation in accordance with the set material type.

* * * * *